US005286703A

United States Patent [19]

Wachi et al.

[11] Patent Number: 5,286,703

[45] Date of Patent: Feb. 15, 1994

[54] HEAT-SENSITIVE RECORDING MATERIAL

[75] Inventors: Naotaka Wachi; Ken Iwakura; Kensuke Ikeda; Katsuya Takemasa, all of Shizuoka, all of Japan

[73] Assignee: Fuji Photo Film Co., Ltd., Kanagawa, Japan

[21] Appl. No.: 795,800

[22] Filed: Nov. 21, 1991

[30] Foreign Application Priority Data

Nov. 22, 1990 [JP] Japan ..... 2-319745
Nov. 29, 1990 [JP] Japan ..... 2-331413

[51] Int. Cl.[5] ..... B41M 5/40

[52] U.S. Cl. ..... 503/221; 427/152; 503/200; 503/226

[58] Field of Search ..... 427/152; 503/200, 226, 503/221

[56] References Cited

FOREIGN PATENT DOCUMENTS 179492 4/1986 European Pat. Off. ..... 503/226
2171810 9/1986 United Kingdom .

*Primary Examiner*—Pamela R. Schwartz
*Attorney, Agent, or Firm*—Sughrue, Mion, Zinn, Macpeak & Seas

[57] ABSTRACT

A heat-sensitive recording material comprising a support having thereon a color-developing layer and at least one UV-absorbing layer with a light-transmittance of 70% or less at 400 nm, 5% or less at 370 nm, and 70% or more for entire visible light range, is disclosed.

7 Claims, 1 Drawing Sheet

HEAT-SENSITIVE RECORDING MATERIAL

FIELD OF THE INVENTION

The present invention relates to a heat-sensitive recording material. More particularly, the present invention relates to a heat-sensitive recording material which has improved light-fastness both at the image portion and at the non-image portion of the recording material.

BACKGROUND OF THE INVENTION

Recording materials which employ an electron-donating colorless dye and an electron-accepting compound are well known. Examples of such recording materials are pressure-sensitive papers, heat-sensitive papers, light-sensitive heat-sensitive papers, electroconductive heat-sensitive papers, heat-sensitive transfer papers, and the like. These are described in detail, for example, in British Patent 2,140,449, U.S. Pat. No. 4,480,052, U.S. Pat. No. 4,436,920, JP-B-60-23992 (the term "JP-B" as used herein means an "examined Japanese patent publication"), JP-A-57-179836 (the term "JP-A" as used herein means an "unexamined published Japanese patent application"), JP-A-60-123556, JP-A-60-123557, and so forth.

In particular, heat-sensitive recording materials have been extensively studied to improve (1) developed color density and color developing sensitivity, and (2) fastness of the color-developing materials.

At the moment, however, heat-sensitive recording materials still have disadvantages in that the non-image portions become colored or the image portions fade due to the action of light after the materials are exposed to sunlight for a long time or are posted in offices for a long term.

Various methods have been investigated to lessen the discoloration of the non-image portions and fading of the image portions. (See JP-A-50-104650, JP-A-58-087093, JP-A-60-203487, JP-A-61-242878 and JP-A-61-193883.) However, satisfactory improvement has not been achieved.

SUMMARY OF THE INVENTION

An object of the present invention is to provide a heat-sensitive recording material which is improved with less discoloration of the non-image portion and less fading of the image portion.

The above and other objects of the present invention are attained by a heat-sensitive recording material comprising a support having thereon a color-developing layer and at least one UV-absorbing layer with a light-transmittance of 70% or less at 400 nm, 5% or less at 370 nm and 70% or more for the entire range of visible light. The UV-absorbing layer preferably contain two or more UV-absorbing agents. The UV-absorbing layer has preferably a light-transmittance of 50% or less at 400 nm, not more than 1% or less at 370 nm, and 90% or more for the entire range of visible light.

BRIEF DESCRIPTION OF THE DRAWINGS

In FIG. 1, Layer A indicates an opaque support, Layer B indicates the heat-sensitive color-developing layer, Layer C indicates the UV-absorbing layer and Layer D indicates the protective layer.

In FIG. 2, Layer A indicates the transparent support, Layer B indicates the heat-sensitive color-developing layer, Layer C indicates the UV-absorbing layer and Layer D indicates a protective layer.

In FIG. 3, Layer A indicates the transparent support, Layer B indicates a heat-sensitive color-developing layer, Layer C indicates the UV-absorbing layer and Layer D indicates a protective layer.

In FIG. 4, Layer A indicates the transparent support, Layer B indicates a heat-sensitive color-developing layer, Layer C indicates the UV-absorbing layer and Layer D indicates a protective layer.

In FIG. 5, Layer A indicates the transparent support, Layer B indicates the heat-sensitive color-developing layer, Layer C indicates the UV-absorbing layer and Layer D indicates a protective layer.

DETAILED DESCRIPTION OF THE INVENTION

Figure 1:
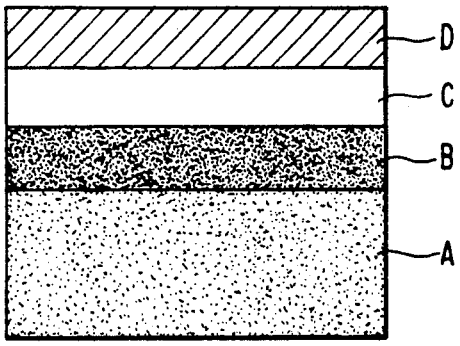
FIG. 1 is a sectional view of a heat-sensitive recording material of the present invention having a UV-absorbing layer between a heat-sensitive color-developing layer and a protective layer.

The present invention is described below in detail.

The present invention provides a heat-sensitive recording material comprising a color-developing layer and at least one UV-absorbing layer on a support, the UV-absorbing layer or layers having light-transmittances of 70% or less at 400 nm, 5% or less at 370 nm, and 70% or more for the entire range of visible light.

The UV-absorbing layer of the present invention contains a UV-absorbing agent distributed uniformly in a binder. The uniformly distributed UV-absorbing agent absorbs UV light effectively to prevent discoloration of the non-image portions, or fading or discoloration of the image portions caused by light-exposure.

In the present invention, any known UV-absorbing agent is useful. The compounds of formulas (I) to (VI) below are preferably used as the UV-absorbing agent:

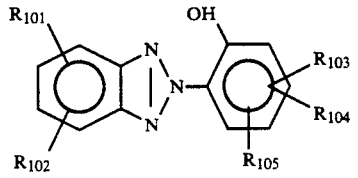

(I)

wherein $R_{101}$, $R_{102}$, $R_{103}$, $R_{104}$ and $R_{105}$, which may be the same or different, each represents a hydrogen atom, a halogen atom, an alkyl group, an alkoxy group, an aryl group, an aryloxy group, an alkenyl group, a nitro group, a carboxyl group, a sulfo group, or a hydroxy group;

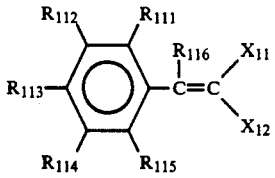

(II)

wherein $R_{111}$, $R_{112}$, $R_{113}$, $R_{114}$, $R_{115}$ and $R_{116}$, which may be the same or different, each represents a hydrogen atom, a halogen atom, an alkyl group, an alkoxy group, an aryl group, an aryloxy group, an arylthio group, an amino group, a cyano group, a nitro group, a carbamoyl group, a sulfonyl group, a sulfamoyl group, a sulfonamido group, a carboxyl group, a sulfo group, an acyloxy group, an oxycarbonyl group or a hydroxy group; and $X_{11}$ and $X_{12}$ which may be the same or different, each represents a cyano group, —$COOR_{117}$, $COONHR_{117}$, —$COR_{117}$, —$SO_2R_{117}$; and —$SO_2NHR_{117}$; in which $R_{117}$ represents an alkyl group or an aryl group; and $X_{11}$ and $X_{12}$ may be linked together to form a 5- to 7-membered ring;

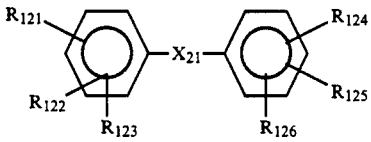

(III)

wherein $R_{121}$, $R_{122}$, $R_{123}$, $R_{124}$, $R_{125}$ and $R_{126}$, which may be the same or different, each represents a hydrogen atom, a halogen atom, an alkyl group, an alkoxy group, an aryl group, an aryloxy group, an arylthio group, an amino group, a cyano group, a nitro group, a carbamoyl group, a sulfonyl group, a sulfamoyl group, a sulfonamido group, a carboxyl group, a sulfo group, an acyloxy group, an oxycarbonyl group or a hydroxy group; and $X_{21}$ represents —CO— or —COO—;

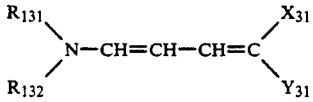

(IV)

wherein $R_{131}$ and $R_{132}$, which may be the same or different, each represent a hydrogen atom, an alkyl group or an aryl group, or a non-metal atom group to form together a 5- or 6- membered ring; and $X_{31}$ and $Y_{31}$, which may be the same or different, each has the same meaning as $X_1$ and $X_2$ in formula (II);

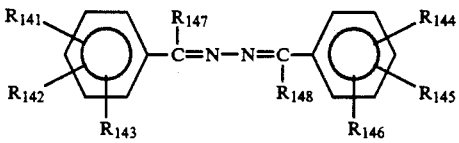

(V)

wherein $R_{141}$ to $R_{146}$, which may be the same or different, each has the same meaning as $R_{111}$ to $R_{116}$ in formula (II); $R_{147}$ and $R_{148}$, which may be the same or different, each represents a hydrogen atom, an alkyl group or an aryl group, or $R_{147}$ and $R_{148}$ may be linked together to form a 5- or 6-membered ring; and

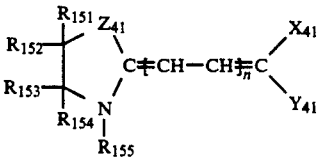

(VI)

wherein $R_{151}$ to $R_{154}$, which may be the same or different, each represents a hydrogen atom, an alkyl group or an aryl group, or $R_{151}$ and $R_{154}$ may form together a double bond, and when $R_{151}$ and $R_{154}$ form together a double bond, $R_{152}$ and $R_{153}$ may form a benzene ring or a naphthalene ring; $R_{155}$ represents an alkyl group or an aryl group; $Z_{41}$ represents an oxygen atom, a sulfur atom, a methylene group, an ethylene group, =N—$R_{156}$ or

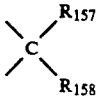

wherein $R_{156}$ represents an alkyl group or an aryl group, and $R_{157}$ and $R_{158}$, which may be the same or different, each represents a hydrogen atom or an alkyl group; n represents 0 or 1; and $X_{41}$ and $Y_{41}$, which may be the same or different, each has the same meaning as $X_{11}$ and $X_{12}$ in formula (II).

In formulas (I) to (VI), the alkyl groups represented by $R_{101}$ to $R_{105}$, $R_{111}$ to $R_{117}$, $R_{121}$ to $R_{126}$, $R_{131}$ and $R_{132}$, $R_{141}$ to $R_{148}$, and $R_{151}$ to $R_{155}$ preferably have 1 to 20 carbon atoms, may be a cycloalkyl group and may be substituted with a substituent such as a hydroxy group, a cyano group, a nitro group, a halogen atom (e.g., chlorine, bromine and fluorine), an alkoxy group (e.g., methoxy, ethoxy, butoxy and octyloxy), an aryloxy group (e.g., phenoxy), an ester group (e.g., methoxycarbonyl, ethoxycarbonyl, octyloxycarbonyl and dodecyloxycarbonyl), a carbonyloxy group (e.g., ethylcarbonyloxy, heptylcarbonyloxy and phenylcarbonyloxy), an amino group (e.g., dimethylamino, ethylamino, and diethylamino), an aryl group (e.g., phenyl), a carbonylamido group (e.g., methylcarbonylamido, and phenylcarbonylamido), a carbamoyl group (e.g., ethylcarbamoyl and phenylcarbamoyl), a sulfonamido group (e.g., methanesulfonamido and benzenesulfonamido), a sulfamoyl group (e.g., butylsulfamoyl, phenylsulfamoyl and methyloctylaminosulfamoyl), a cyano group, a carboxyl group and a sulfo group. Specific examples of the alkyl group include methyl, ethyl, propyl, isopropyl, butyl, s-butyl, t-butyl, pentyl, t-pentyl, hexyl, octyl, 2-ethylhexyl, t-octyl, decyl, dodecyl, hexadecyl, octadecyl, benzyl, phenethyl, and the like, and those substituted with the above-listed substituents.

Specific examples of suitable cycloalkyl groups include cyclopropyl, cyclopentyl, cyclohexyl, and bicyclo-[2.2.2]octyl, and those substituted with substituent listed above in the definition of the alkyl groups.

Typical aryl groups are preferably those having from 6 to 10 carbon atoms and they may be substituted with a substituent such as an alkyl group (e.g., methyl, ethyl, propyl, isopropyl, butyl, pentyl, t-pentyl, hexyl, octyl, 2-ethylhexyl, t-octyl, decyl, dodecyl and hexadecyl) or the substituents described above in the definition of the alkyl groups. Specific examples of suitable aryl groups include phenyl and naphthyl.

Specific examples of alkenyl include 2-butenyl, 3-butenyl, oleyl and the like. These may be substituted with a substituent listed above in the definition of the alkyl groups.

Specific examples of suitable UV-absorbing agents represented by formulas (I) to (VI) are shown below but the present invention is not to be construed as being limited to these examples anyway.

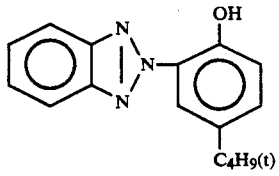

(I)-1

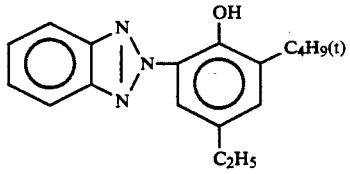

(I)-2

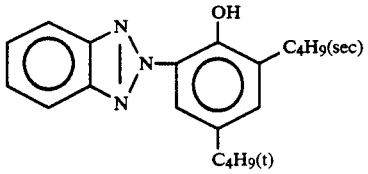

(I)-3

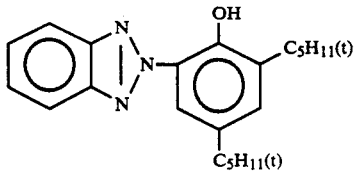

(I)-4

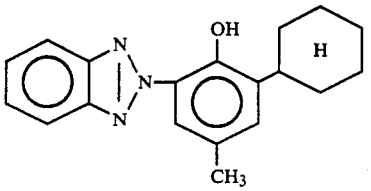

(I)-5

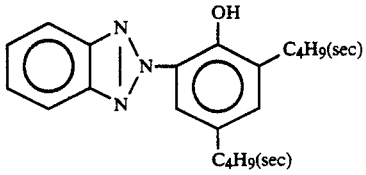

(I)-6

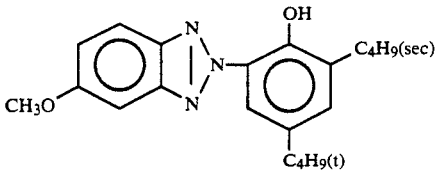

(I)-7

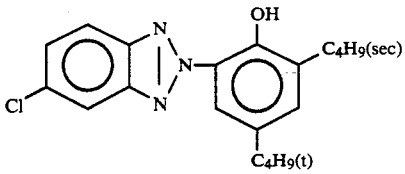

(I)-8

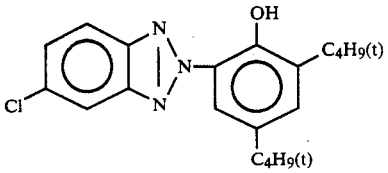

(I)-9

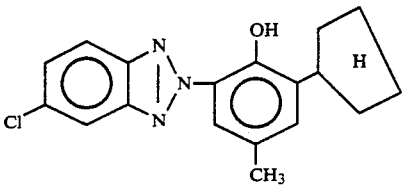

(I)-10

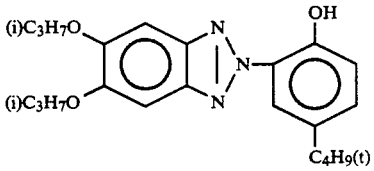

(I)-11

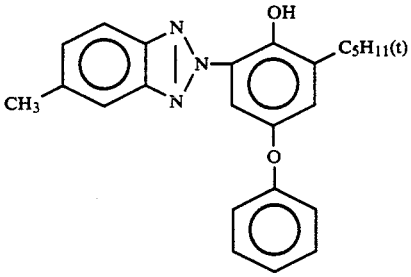

(I)-12

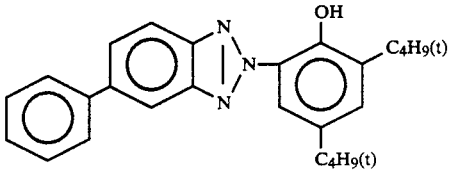

(I)-13

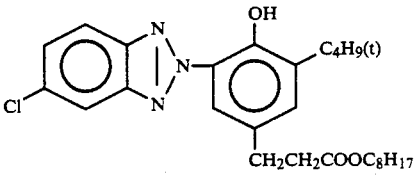

(I)-14

-continued
(I)-15
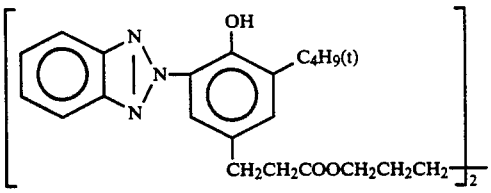
(I)-16
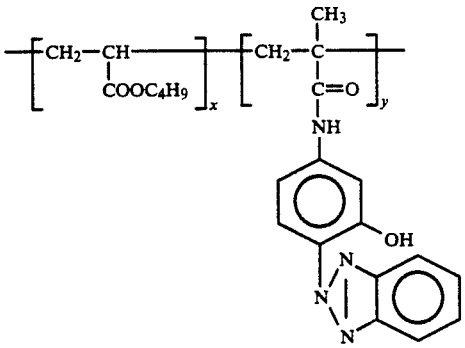
(I)-17
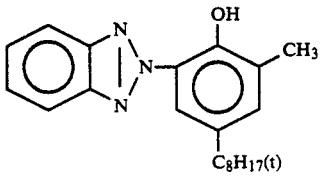
(I)-18
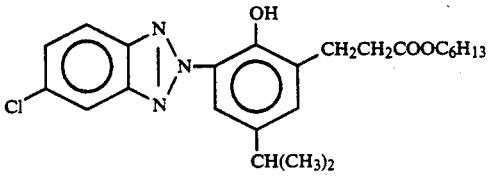
(II)-1
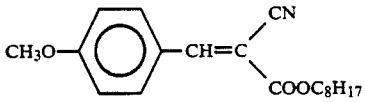
(II)-2
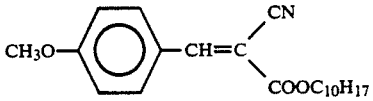
(II)-3
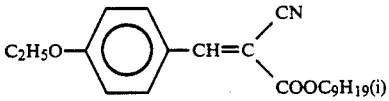
(II)-4
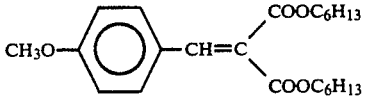
(II)-5
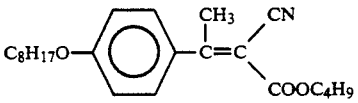
(II)-6
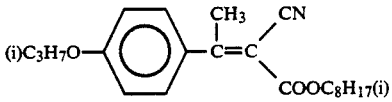
(II)-7
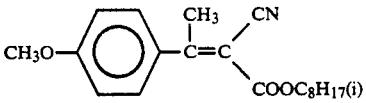
(II)-8
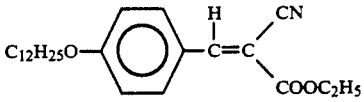
(II)-9
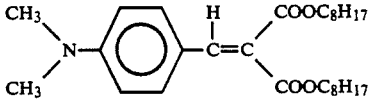
(II)-10
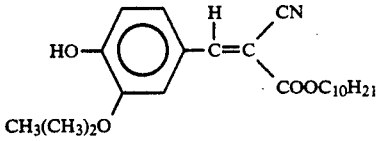
(II)-11
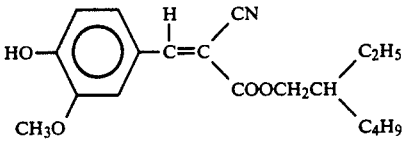
(II)-12
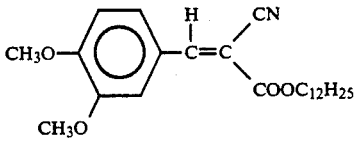

-continued
(II)-13
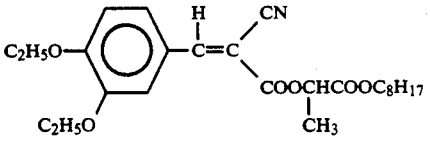
(II)-14
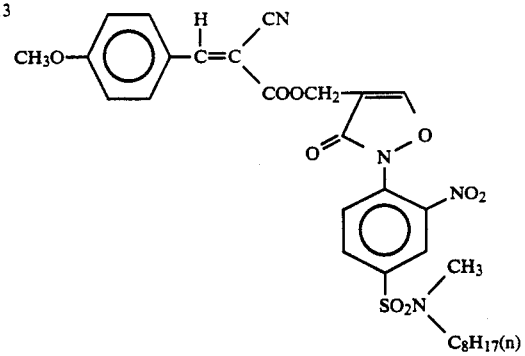
(II)-15
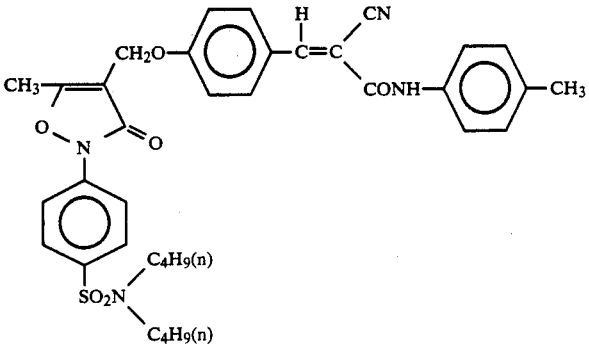
(II)-16
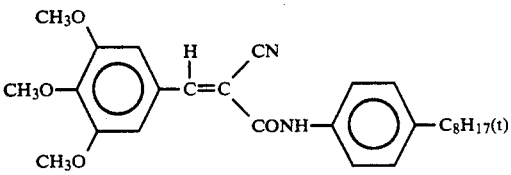
(II)-17
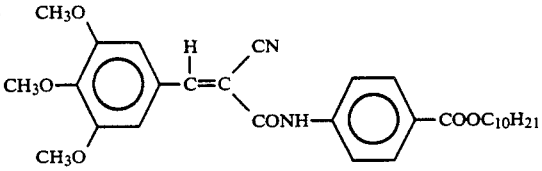
(II)-18
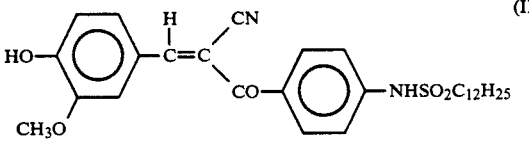
(II)-19
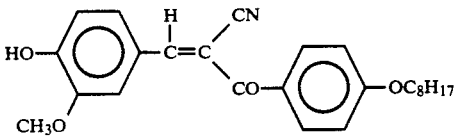
(II)-20
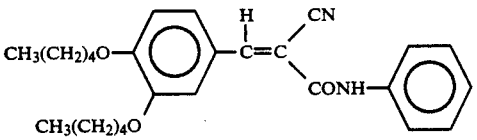
(II)-21
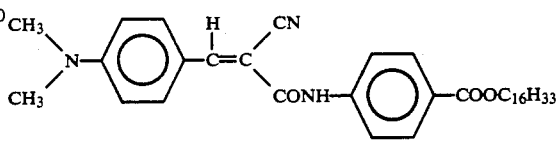
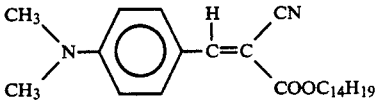
(II)-22
(II)-23
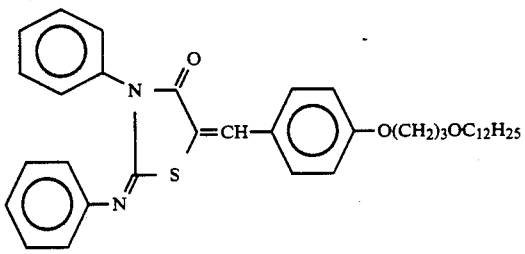

-continued
(II)-24
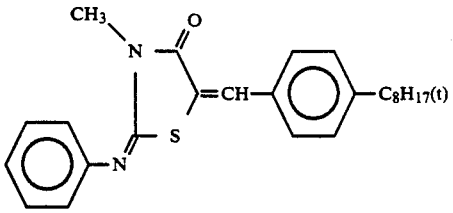
(II)-25
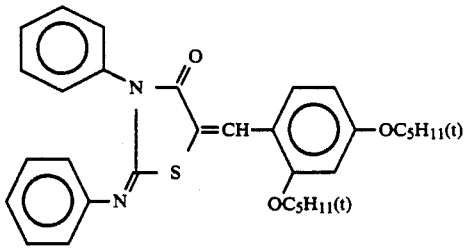
(II)-26
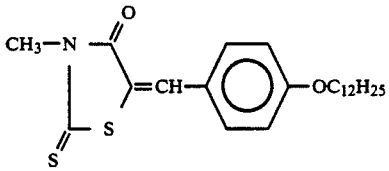
(II)-27
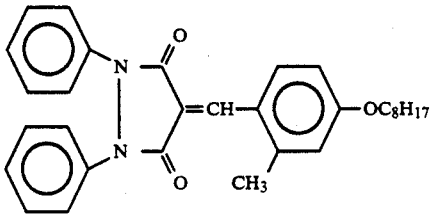
(II)-28
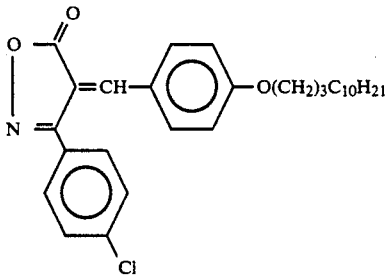
(II)-29
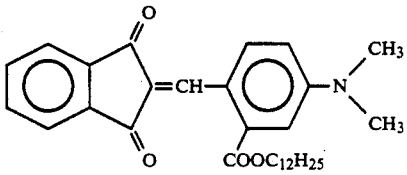
(II)-30
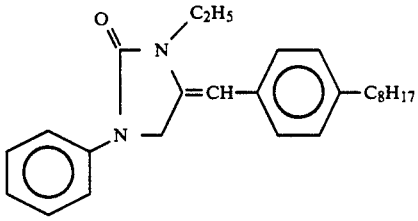
(II)-31
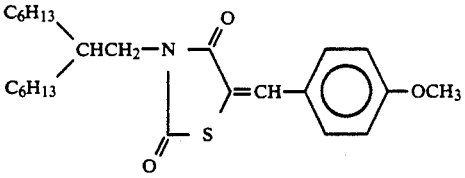
(II)-32
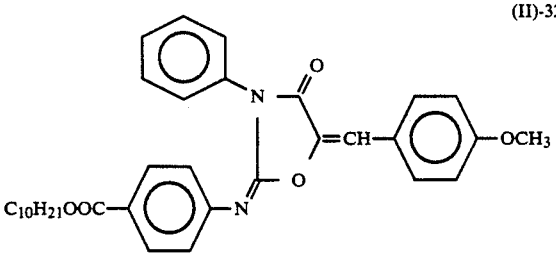
(II)-33
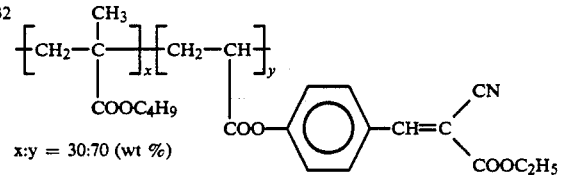
x:y = 30:70 (wt %)
(II)-34
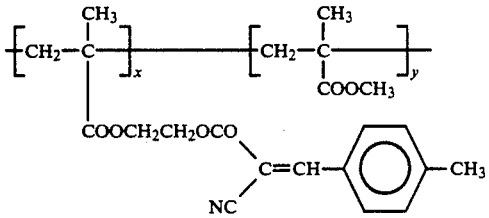
x:y = 70:30 (wt %)

-continued
(II)-35
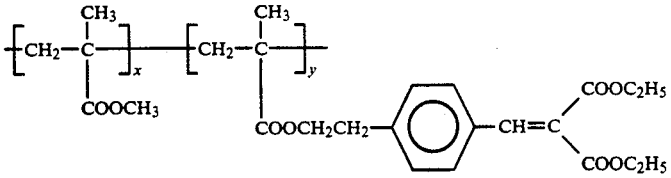
x:y = 25:75 (wt %)
(II)-36
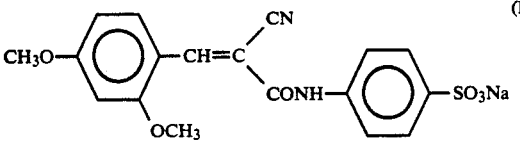
(II)-37
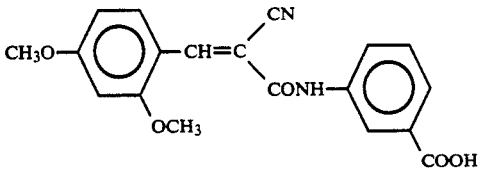
(III)-1
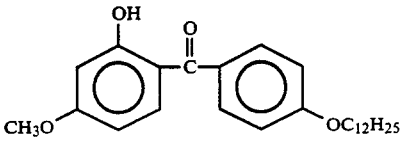
(III)-2
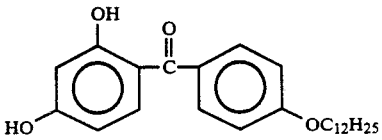
(III)-3
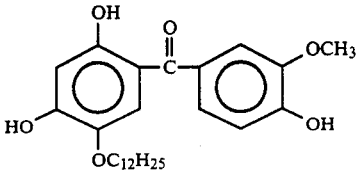
(III)-4
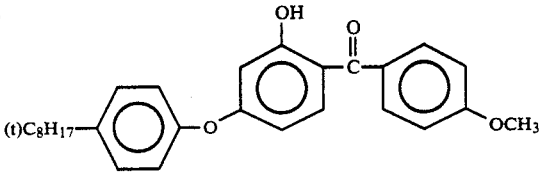
(III)-5
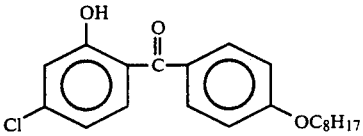
(III)-6
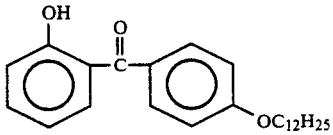
(III)-7
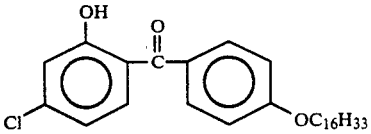
(III)-8
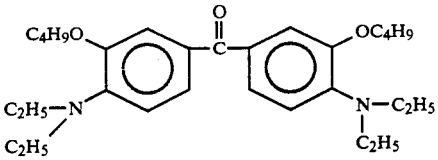
(III)-9
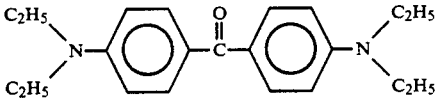
(III)-10
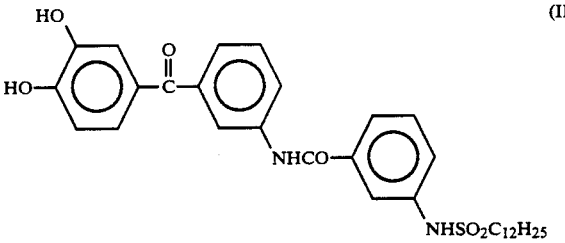
(III)-11
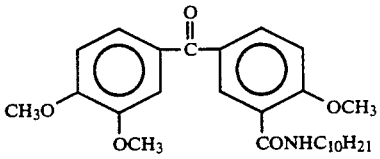
(III)-12
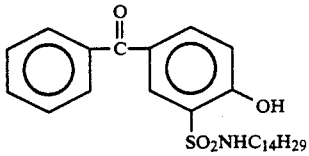
(III)-13
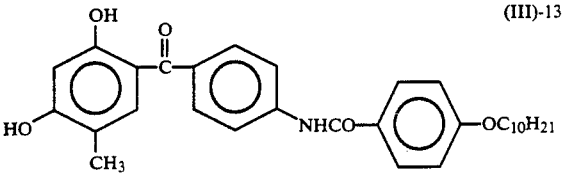
(III)-14
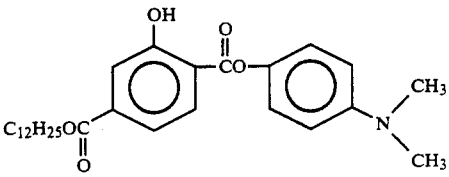

-continued
(III)-15
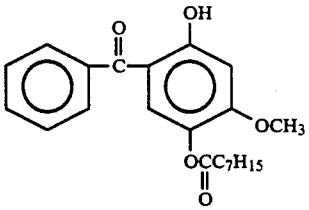
(III)-16
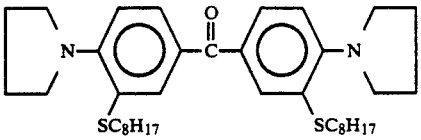
(III)-17
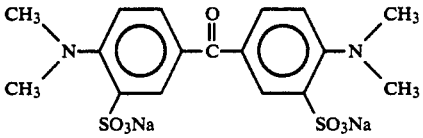
(IV)-1
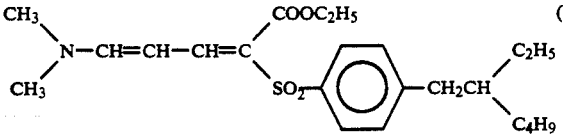
(IV)-2
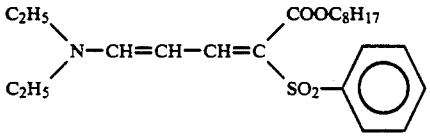
(IV)-3
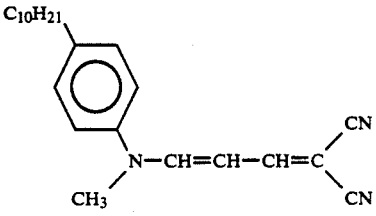
(IV)-4
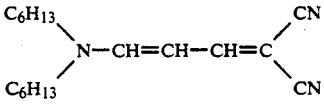
(IV)-5
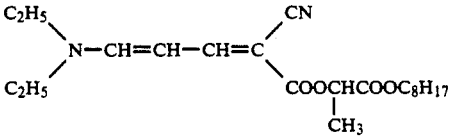
(IV)-6
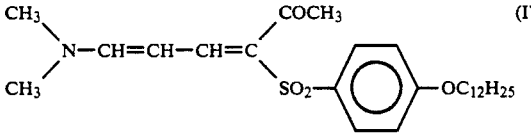
(IV)-7
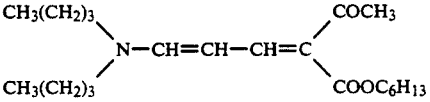
(IV)-8
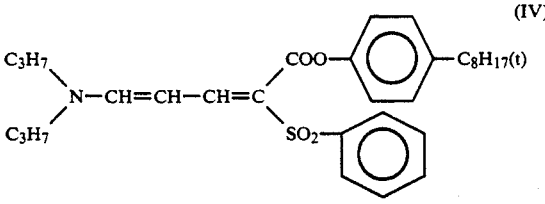
(IV)-9
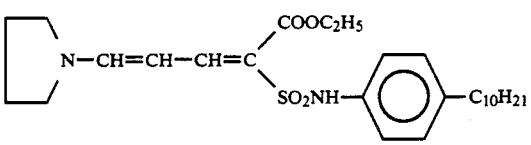
(IV)-10
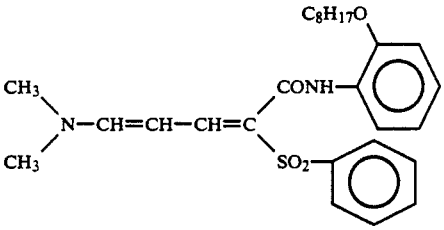
(IV)-11
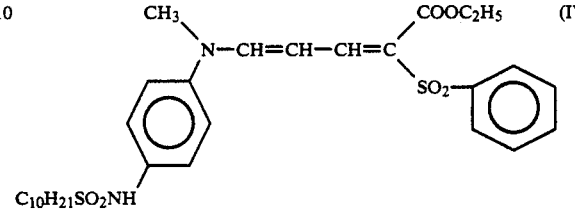
(V)-1
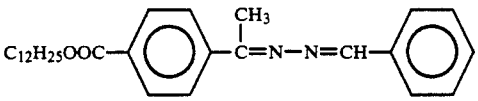
(V)-2
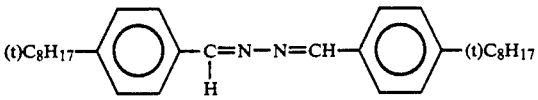

-continued
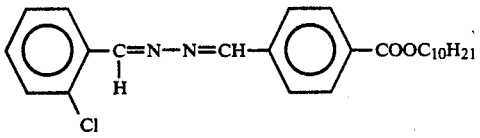
(V)-3
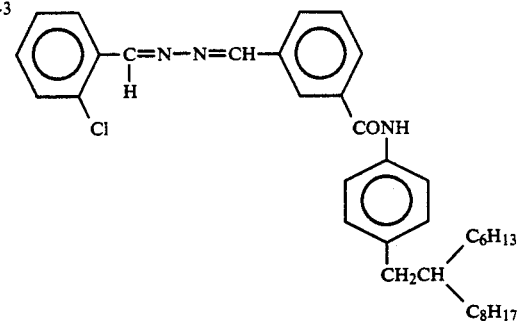
(V)-4
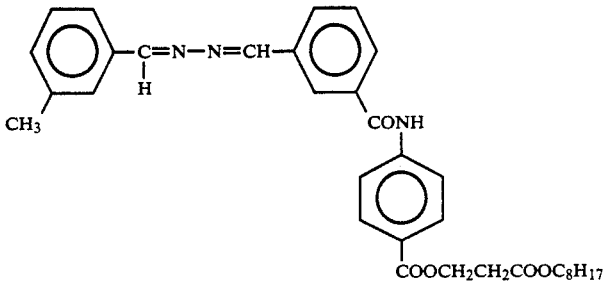
(V)-5
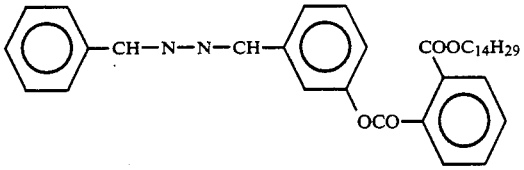
(V)-6
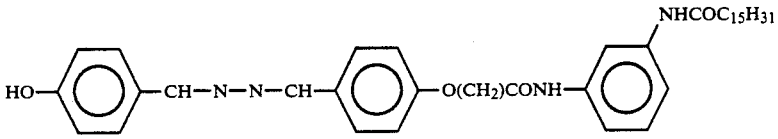
(V)-7
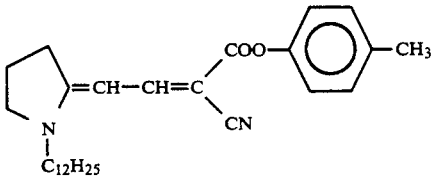
(VI)-1
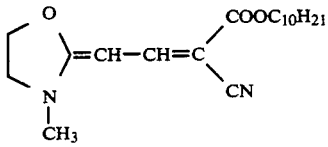
(VI)-2
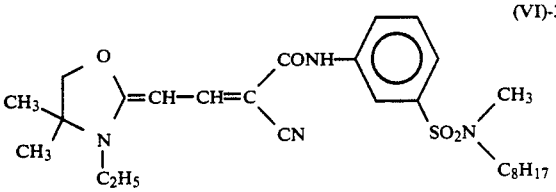
(VI)-3
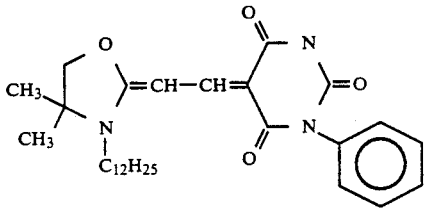
(VI)-4

-continued (VI)-5

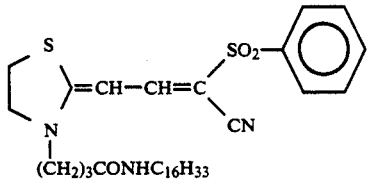

(VI)-6

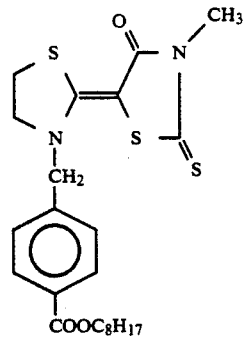

(VI)-7

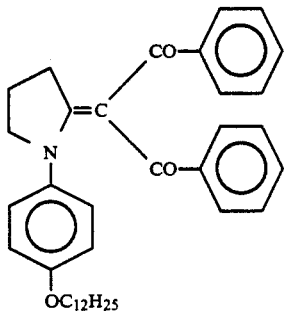

(VI)-8

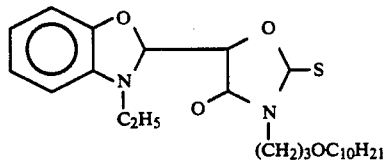

(VI)-9

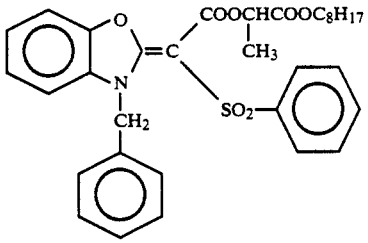

(VI)-10

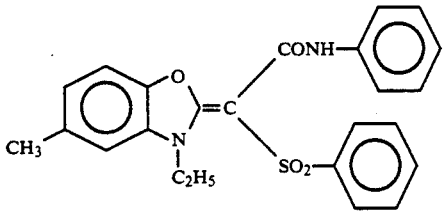

(VI)-11

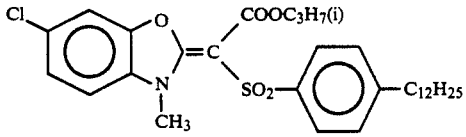

The 2-(2'-hydroxyphenyl)benzotriazole UV-absorbing agents represented by formula (I) may be either solid or liquid, but liquid compounds are preferable. Specific examples of the liquid compounds are described, for example, in JP-B-55-36984, JP-B-55-12587, JP-A-58-214152, and so forth. Additionally, details of the UV-absorbing agents represented by general formula (I) are described in JP-A-58-212844, JP-A-59-46646, JP-A-59-109055, JP-B-36-10466, JP-B-42-26187, JP-B-48-5496, JP-B-48-41572, U.S. Pat. Nos. 3,754,919 and 4,220,711.

UV-absorbing agents represented by formula (II) are described, for example, in JP-B-48-31255 JP-B-50-10726, U.S. Pat. Nos. 2,719,086, 3,214,463, 3,284,203 and 3,698,707, or otherwise are derivable by synthesis using the methods described therein.

UV-absorbing agents represented by formula (III) are described, for example, in U.S. Patent 3,707,375, JP-B-48-30492, JP-A-47-10537, JP-A-58-111942, JP-A-59-19945 and JP-A-63-53544, or otherwise they may be synthesized using the methods as described therein.

UV-absorbing agents represented by formula (IV) may be synthesized in accordance with methods as described, for example, in JP-A-51-56620, JP-A-53-128333 and JP-A-58-181040.

UV-absorbing agents represented by formula (V) are described, for example, in British Patent 1,198,337 and JP-A-63-53544, or otherwise they may be synthesized in accordance with methods as described therein.

UV-absorbing agents represented by formula (VI) are described, for example, in U.S. Pat. No. 4,360,588 and JP-A-63-53544, or otherwise they may be synthesized in accordance with methods as described therein.

UV-absorbing agents represented by formulas (I) to (VI), which are substantially water-insoluble, are used as a solution in an organic solvent. Suitable organic solvents include low-boiling organic solvents such as methyl acetate, ethyl acetate, carbon tetrachloride, chloroform, methanol, ethanol, n-butanol, dioxane, acetone, benzene and the like; and high-boiling organic solvents such as phosphoric acid esters, phthalic acid esters, other carboxylic acid esters, fatty acid amide, alkylated biphenyl, alkylated terphenyl, chlorinated paraffin, alkylated naphthalene, diarylethane, and the like. Specific examples of suitable high-boiling organic solvents are tricresyl phosphate, trioctyl phosphate, octyl diphenyl phosphate, tricyclohexyl phosphate, dibutyl phosphate, dioctyl phthalate, dilauryl phosphate, dicyclohexyl phthalate, butyl oleate, diethylene glycol dibenzoate, dioctyl sebacate, dibutyl sebacate, dioctyl adipate, trioctyl trimellitate, triethyl acetylcitrate, octyl maleate, dibutyl maleate, isoamylbiphenyl, chlorinated paraffin, diisopropylnaphthalene, 1,1'-ditolylethane, 2,4-di-t-amylphenol, and N,N-dibutyl-2-butoxy-5-t-octylaniline. The organic solvent used may be a mixture of the above-described low-boiling organic solvent and high-boiling organic solvent. Further, an additive such as a hindered phenol, a hindered amine, a hydroquinone derivative, and the like may be added to the above-described solvent mixture. Preferably two or more types of UV-absorbing agents are used in admixture. This is because, when the UV-absorbing agent is used alone, it tends to crystallize and deposit in the UV-absorbing layer to lower markedly the visible light transmittance or to lower the UV-light absorption efficiency.

The solution thus obtained of the UV-absorbing agent in an organic solvent is dispersed and emulsified in an aqueous gelatin solution, an aqueous polyvinyl alcohol solution, or the like using dispersion means such as a colloid mill and a homogenizer or by applying ultrasonic. A surface active agent may be added thereto during the emulsification if desired.

Figure 2:
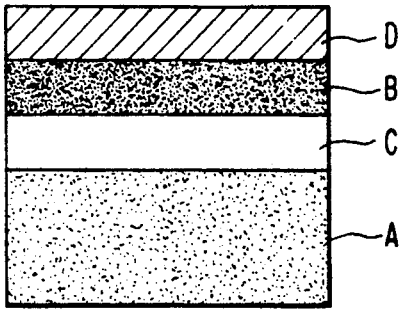
FIG. 2 is a sectional view of a heat-sensitive recording material of the present invention with a UV-absorbing layer between a heat-sensitive color-developing layer and a transparent support.
Figure 3:
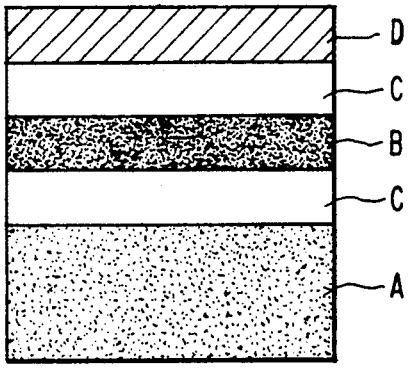
FIG. 3 is a sectional view of a heat-sensitive recording material of the present invention with a UV-absorbing layer on the both surface of a transparent heat-sensitive color-developing layer.
Figure 4:
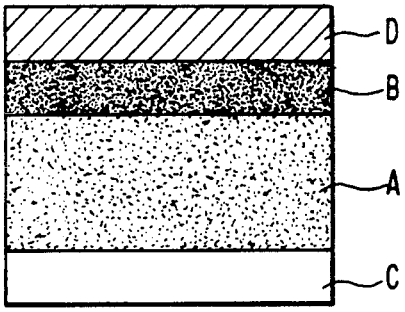
FIG. 4 is a sectional view of a heat-sensitive recording material of the present invention with a UV-absorbing layer on the back surface of a transparent support.
Figure 5:
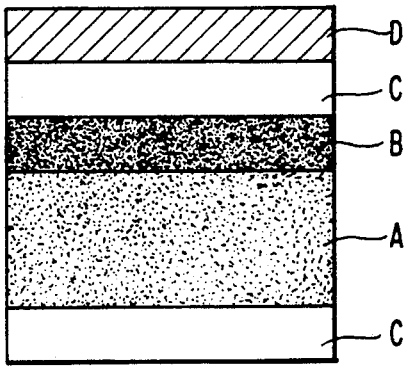
FIG. 5 is a sectional view of a heat-sensitive recording material of the present invention with two UV-absorbing layers, one positioned between a transparent heat-sensitive color-developing layer and a transparent protective layer, and another positioned on the back side of a transparent support.

The UV-absorbing layer of the present invention is prepared with the resulting emulsion. The UV-absorbing layer of the present invention may serve also as an intermediate layer or a protecting layer. Preferably, the UV-absorbing layer is positioned as an intermediate layer by coating on the heat-sensitive color-developing layer. At least one UV-absorbing layer must be placed at the observation side relative to the heat-sensitive color-developing layer. The details of the positional relationship between the UV-absorbing absorbing layer and the heat-sensitive color-developing layer are shown in FIG. 1 to 5 of the accompanying drawings.

The amount of the UV-absorbing agent in the UV-absorbing layer of the present invention may be varied within a range, but preferably is from 0.01 to 2.00 g/m$^2$.

The UV-absorbing layer of the present invention is effectively used in known heat-sensitive recording materials. Examples of heat-sensitive recording materials are those comprising an electron-donating colorless dye and an electron-accepting compound as described, for example, in U.S. Pat. Nos. 4,771,034 and 4,839,332, JP-A-63-22682, JP-A-63-265682, JP-A-63-227375 and JP-A-1-105782, and a light-sensitive heat-sensitive recording material comprising a diazo compound, a coupling component, and an alkali-producing agent or a color-developing aid as described, for example, in JP-B-2-28479, JP-B-2-31674, JP-B-2-20434.

The support employed in the present invention may be a paper such as wood-free paper, coated paper, and polyethylene terephthalate-laminated paper, or a synthetic resin film such as polyethylene terephthalate and synthetic paper.

As a preferred embodiment of the heat-sensitive recording material comprising an electron-donating colorless dye and an electron-accepting compound according to the present invention, a recording material which comprises a support having thereon a color-developing layer comprising an electron-donating colorless dye and an electron-accepting compound and a UV-absorbing layer, the electron-donating colorless dye being a fluoran compound having an anilino group substituted at the benzene ring thereof with an electron-attracting group, is described below in detail.

The fluoran compounds employed in this embodiment preferably have a xanthene skeleton moiety substituted at the 2- and 6-positions with an amino group.

More preferably, the fluoran compounds have an anilino group substituted at the 2-position of the benzene ring thereof with an electron-attracting group.

Still more preferably, the fluoran compound has a developed color hue of from greenish black to reddish black.

Of the fluoran compounds which can be used in this embodiment, those represented by the following general formula (VII), as disclosed in JP-A-51-44008, are preferred:

(VII)

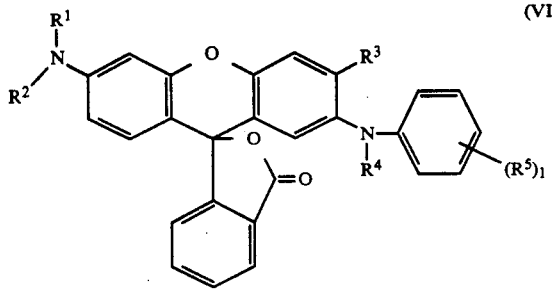

wherein $R^1$ and $R^2$, which may be the same or different, each represents a hydrogen atom, an unsubstituted or substituted alkyl, alkenyl, alkynyl, aralkyl, aryl, alkoxyalkyl, aryloxyalkyl or tetrahydrofurfuryl group, and $R^1$ and $R^2$ may combine together and form a hetero ring; $R^3$ represents a hydrogen atom, an alkyl group, an alkenyl group, an alkynyl group, an aralkyl group, an aryl group, an alkoxy group, an alkoxyalkyl group, an acyl group, a halogen atom, an alkylsulfonyl group or an arylsulfonyl group; $R^4$ represents a hydrogen atom, an unsubstituted or substituted alkyl, alkenyl, alkynyl, aralkyl, aryl, acyl, alkoxycarbonyl or aryloxycarbonyl group; $R^5$ represents an electron-attracting group; 1 is an integer of from 1 to 5, and when 1 is 2 or more, the $R^5$'s may be the same or different.

Preferred examples of $R^1$ and $R^2$ include $-CH_3$, $-C_nH_{2n-1}YZ$, $-C_nH_{2n-3}$, $-C_nH_{2n}OC_mH_{2m-1}YZ$, $-C_nH_{2n}OC_6H_4YZ$, $-C_6H_4YZ$, $-CH_2C_6H_4YZ$, $-C_6H_5C_mH_{2m-1}YZ$, $-C_6H_5NYZ$, $-(CH_2)_n-$, and $-(CH_2)_n-X-(CH_2)_m-$, wherein n is an integer of from 2 to 10; m is an integer of from 1 to 5; X is an oxygen or sulfur atom or a substituted amino group; and Y and Z independently represents a halogen atom or an alkyl, alkenyl, alkynyl, aryl, substituted amino, alkoxy, aryloxy, alkylthio, nitro, cyano, acyl or the like group. Examples of the substituent of the substituted amino group include a hydrogen atom, an alkyl group having from 1 to 6 carbon atoms and a phenyl group, and examples of the halogen atom include a fluorine atom, a chlorine atom and a bromine atom. More preferred examples of $R^1$ and $R^2$ include methyl, ethyl, propyl, butyl, pentyl, hexyl, heptyl, octyl, nonyl, decyl, cyclohexyl, phenyl, p-tolyl, benzyl, piperidino, pyrrolidino, morpholino, ethoxyethyl, ethoxypropyl, tetrahydrofurfuryl and the like groups.

Preferred examples of $R^3$ in formula (I) include a hydrogen atom, an alkyl or alkoxy group having from 1 to 5 carbon atoms, an aryl group having from 6 to 10 carbon atoms, a halogen atom (e.g., a fluorine atom, a chlorine atom, a bromine atom), and the like. Among them, a hydrogen atom is particularly preferred.

Preferred examples of $R^4$ in formula (I) include a hydrogen atom, an alkyl or alkoxy group having from 1 to 5 carbon atoms, an aryl group having from 6 to 10 carbon atoms, an acyl group and the like. Among them, hydrogen is particularly preferred.

Preferred examples of $R^5$ in formula (I) include a halogen atom (e.g., a fluorine atom, a chlorine atom, a bromine atom), a nitro, cyano, halogenated alkyl (e.g., alkyl groups having from 1 to 4 carbon atoms and substituted by the halogen atom), acyl, alkoxycarbonyl, amido, carbamoyl, alkylsulfonyl, arylsulfonyl, sulfonamido groups and the like. Additionally, these groups may be substituted.

Particularly preferred substituents represented by $R^5$ are those having a Hammet's o value of not less than 0.2. Specific examples thereof include fluorine, chlorine and cyano, trifluoromethyl, acetyl, benzoyl, methoxycarbonyl, ethoxycarbonyl and methanesulfonyl groups.

Specific examples of the fluoran compounds which can preferably be used in the present invention are listed below. However, the present is not to be construed as being limited to these examples.

(VII-1) 2-p-Tifluoromethyanilino-6-N-ethyl-N-isobutylaminofluoran;
(VII-2) 2-m-Trifluoromethylanilino-6-N,N-diethylaminofluoran;
(VII-3) 2-o-Trifluoromethyanilino-6-N-ethyl-N-isobutylaminofluoran;
(VII-4) 2-o-Fluoroanilino-6-N,N-dibutylaminofluoran;
(VII-5) 2-p-Cyanoanilino-6-N,N-diethylaminofluoran;
(VII-6) 2-m-Methanesulfonylanilino-6-N,N-diethylaminofluoran;
(VII-7) 2-p-Methanesulfonylanilino-6-N,N-dibutylaminofluoran;
(VII-8) 2-o-Methoxycarbonylanilino-6-N,N-dimethylaminofluoran;
(VII-9) 2-o-Ethoxycarbonylanilino-6-N-ethyl-N-tetrahydrofurfurylaminofluoran;
(VII-10) 2-p-Acetylanilino-6-piperidinofluoran;
(VII-11) 2-p-Benzoylanilino-6-N,N-diethylaminofluoran;
(VII-12) 2-o-Chloroanilino-6-N-ethyl-N-p-tolylaminofluoran;
(VII-13) 2-(3',5'-Difluoroanilino)-6-N-ethyl-N-isobutylaminofluoran;
(VOO-14 2-(2', 6'-Difluoroanilino)-6-N-ethyl-N-isopropylaminofluoran;
(VII-15) 2-(2',4'-Dichloroanilino)-6-N-ethyl-N-ethoxypropylaminofluoran;
(VII-16) 2-(2'-Cyano-4'-methanesulfonylanilino)-3-methyl-6-N,N-diethylaminofluoran;
(VII-17) 2-p-Trifluoromethylanilino-3-chloro-6-N-ethyl-N-p-tolylaminofluoran;
(VII-18) 2(2'-Fluoro-4,-trifluoromethylanilino)-3-methyl-6-N,N-diethylaminofluoran;
(VII-19) 2-2',3',4',5',6'-Pentafluoroanilino-3-ethyl-6-N-ethyl-N-cyclohexylaminofluoran;
(VII-20) 2-p-Cyanoanilino-3-methoxy-6-N-ethyl-N-tetrahydrofurfurylaminofluoran The fluoran compound of the general formula (I) can be synthesized in the manner as described, for example, in JP-A-51-44008 and JP-A-57-195155.

The fluoran compound employed in this embodiment may be used alone or in combination with another known electron-donating colorless dyes, if desired. In such a case, the fluoran compound of this embodiment is preferably used in an amount of 40% by weight or more based on the total weight of the combination in view of improvement of properties.

The above-described another known electron-donating colorless dyes include various types of compounds such as triphenylmethanephthalides, fluorans, phenothiazines, indolylphthalides, leucoauramines, rhodaminelactams, triphenylmethanes, triazenes, spiropyrans, fluorenes, and the like.

The phthalides are specifically described in U.S. Pat. Re 23,024; and U.S. Pat. Nos. 3,491,111, 3,491,112, 3,491,116, and 3,509,174. The fluorans are specifically described in U.S. Pat. Nos. 3,624,107, 3,627,787, 3,641,011, 3,462,828, 3,681,390, 3,920,510, and 3,959,571. The spirodipyrans are specifically described in U.S. Pat. No. 3,971,808. The pyridines and pyrazines are specifically described in U.S. Pat. Nos. 3,775,424, 3,853,869, and 4,246,318. The fluorenes are specifically described in JP-A-63-94878, etc.

The electron-accepting compound which produces a color on contact with a colorless dye includes conventional compounds such as phenol derivatives, salicylic acid derivatives, aromatic carboxylic acid salts of metals, acid clay, bentonite, novolak resins, metal-treated novolak resins, and metal complexes, which may be used alone or as a combination of two or more thereof. Specific examples of these compounds are described, for example, in JP-B-40-9309, JP-B-45-14039, JP-A-52-140483, JP-A-48-51510, JP-A-57-210886, JP-A-58-87089, JP-A-59-11286, JP-A-60-176795, JP-A-61-95988, and U.S. Pat. Nos. 3,767,449, 4,219,219, 4,269,893, 4,374,671 and 4,687,869. Particularly preferred are combinations of a salicylic acid derivative and a phenol derivative.

Specific examples of electron-accepting compounds include bisphenol-A, 2,2-bis(3-methyl-4-hydroxyphenyl)propane, 2,2-bis(4-hydroxyphenyl)heptane, 1,1-bis(4-hydroxy phenyl)butane, 1,1-bis(4-hydroxyphenyl)-2-ethylhexane, 1,1- bis(3-chloro-4-hydroxyphenyl)-2-ethylbutane, bis(3-allyl-4hydroxyphenyl)sulfone, 1,7-bis(4-hydroxyphenylthio)-3,5-dioxaheptane, (4-hydroxyphenyl)-(4-isopropoxyphenyl)sulfone, benzyl 4-hydroxybenzoate, β-phenoxyethyl 2,4-dihydroxybenzoate, α-methyl-β-(3-methoxyphenoxy)ethyl 2,4-dihydroxybenzoate, 1,3-bis(4-hydroxyphenyl)propane, 2-(2,4-dihydroxyphenyl)-2-phenylpropane, zinc 3,5-bis-(α-methylbenzyl)salicylate and the like.

The UV-absorbing layer of the present invention has a light-transmittance of 70% or less 400 nm, 5% or less at 370 nm and 70% or more for the entire range of visible light. The UV-absorbing layer preferably contain two or more UV-absorbing agents. The UV-absorbing layer has preferably a light-transmittance of 50% or less at 400 nm, 1% or less at 370 nm and 90% or more for the entire range of visible light.

The UV-absorbing agent is present in the UV-absorbing layer in an amount of from 0.01 to 2.0 g/mz The UV-absorbing agent may also be present in the color-developing layer. In such a case, the total amount of the UV-absorbing agent in the entire of the heat-sensitive recording material of the present invention ranges preferably from 0.11 to 3.0 $g/m^2$.

The coating liquid for forming the UV-absorbing layer of the present invention can be prepared using a known methods such as emulsion dispersion or solid dispersion method. The UV-absorbing agent may also be incorporated in microcapsules.

The UV-absorbing layer may be formed by applying the coating liquid using bar coating, blade coating, air-knife coating, gravure coating, roll coating, spray coating, dip coating, or a like method.

The UV-absorbing layer may serve simultaneously as an intermediate layer or a protective layer. However, the UV-absorbing layer is preferably provided as an intermediate layer adjacent to the color-developing layer but at least on UV-absorbing layer must be provided on the observation side relative to the color-developing layer.

The heat-sensitive recording material of this embodiment can be used as a heat-sensitive paper in a form such that the UV-absorbing layer is provided on a recording material as described in JP-A-62-144989 and JP-A-1-87291, and so forth. Specifically, a coating liquid which contains a dispersion of a solid electron-donating colorless dye and a solid electron-accepting compound as the main components, and additives such as a binder, and a coating liquid for the UV-absorbing layer are prepared and subsequently the coating liquids are applied and dried on a support such as a paper sheet or a synthetic resin film to produce a heat-sensitive recording material.

The electron-donating colorless dye and the electron accepting compound can be used in a form of a pulverized dispersion in a dispersion medium with a particle diameter of 10 μm or less, preferably 3 μm or less. The dispersion medium generally used includes aqueous solutions of a water-soluble polymer at a concentration of from about 0.5 to about 10% by weight. The dispersion process can be conducted using a ball mill, a sand mill, a lateral sand mill, an attritor, a colloidal mill, and the like.

The electron-donating colorless dye and the electron-accepting compound are used preferably in a ratio within the range of from 1:20 to 1:1, more preferably from 1:10 to 2:3 by weight.

The heat-sensitive color-developing layer may contain a heat-fusible material for improving responsiveness to heat. Typical heat-fusible materials are aromatic ethers, thioethers and esters, and aliphatic amides and ureides. These materials are described, for example, in JP-A-58-57989, JP-A-58-87094, JP-A-61-58789, JP-A-62-109681, JP-A-62-132674, JP-A-63-151478, JP-A-63-235961, JP-A-2-184489, JP-A-2-2215585, and other literature.

Specific examples of heat-fusible materials include phenethyl biphenyl ether, benzyloxynaphthalene, benzylbiphenyl, 1,2-diphenoxyethane, 1,2-di-m-tolyloxyethane, 1-phenoxy-2-p-methoxyphenoxyethane, 1-p-methoxyphenoxy-2-o-chlorophenoxyethane, 1,2-di-p-fluorophenoxyethane, 1,3-di-p-methoxyphenoxypropane, 1,2-di-p-methoxyphenoxypropane, 1-phenoxy-2-p-methoxyphenoxypropane, 1-p-methoxyphenoxyethoxy-2-p-methoxyphenoxyethane, 1,2-di-p-methoxyphenylthioethane, p-methoxybenzyloxytolylmethane, (4-methoxybenzyloxy)-(3-methyl-4-chlorophenyl)methane, p-chlorobenzyloxy-p-ethoxyphenylmethane, and the like.

Such a material is finely dispersed simultaneously with the electron-donating colorless dye or the electron-accepting compound, in an amount preferably 20% or more to 300% or less by weight, more preferably 40% or more to 150% or less by weight based on the electron-accepting compound.

The coating solution thus prepared may further contain additives for various other purposes, if required. For example, an oil-absorbing substance such as an inorganic pigment and a polyurea filler is dispersed in the binder for preventing scumming of the recording head during recording. Another example of the additive is a fatty acid, a metal soap, or the like for increasing releasability from the recording head. Accordingly, the recording material is generally produced by applying, on a support, an electron-donating colorless dye and an electron-accepting compound which directly result in color-development, and additional additives such as a heat-fusible material, a pigment, a wax, an antistatic agent, a UV-absorbing agent, an antifoaming agent, an electroconductive substance, a fluorescent dye, and a surface active agent.

Further, a protective layer may be provided on the surface of the heat-sensitive recording layer. The protective layer may comprise of two or more layers. Furthermore, a coating liquid similar to the protective layer may be applied onto the back surface of the support to provide curl-balance to the support or to improve chemical resistance of the back surface. An adhesive may be applied to the back surface of the support and combined with a release paper to prepare a recording material in a label form.

The electron-donating colorless dye and the electron-accepting compound are usually applied as a dispersion in a binder. The binder is usually water-soluble, and examples thereof include polyvinyl alcohol, hydroxyethylcellulose, hydroxypropylcellulose, epichlorohydrin-modified polyamide, ethylene-maleic anhydride copolymers, styrene-maleic anhydride copolymers, isobutylene-maleic anhydride copolymers, polyacrylic acid, polyacrylamide, methylol-modified polyacrylamide, starch derivatives, casein, gelatin, and the like. A water-resistance-improving agent or an emulsion of a hydrophobic polymer may be added to the binder to impart water-resistance thereto. The emulsion of the hydrophobic polymer specifically includes styrene-butadiene rubber latexes, acrylic resin emulsions, and the like.

The resulting heat-sensitive coating liquid is coated on a support such as a wood-free paper, a wood-free paper having a subbing layer, a synthetic paper, a synthetic resin film such as a polyethylene terephthalate film and a triacethylcellulose film. The support has a smoothness of preferably 500 seconds or more, more preferably 800 seconds or more, measured according to JIS-P8119 in view of dot reproducibility.

When a subbing layer containing a pigment as the main component is provided on the support, any pigment, organic or inorganic, may be employed therefor. Particular preferred pigments are those which exhibit an oil absorption degree of not less than 40 cc/100 g, measured according to JIS-K5101. Specific examples of suitable pigments are calcium carbonate, barium sulfate, titanium oxide, talc, agalmatolite, kaolin, calcined kaoline, aluminum hydroxide, amorphous silica, powdery urea-formalin resins, and powdery polyethylene resins.

The pigment is applied on the support in an amount preferably of 1 g/m$^2$.

Suitable binders for the subbing layer includes water-soluble polymers and water-insoluble binders, and combination of two or more thereof may be used if desired.

The water-soluble polymer for the binder of the subbing layer includes methylcellulose, carboxymethylcellulose, hydroxyethylcellulose, starch and its derivatives, gelatin, gum arabic, casein, hydrolyzed styrene-maleic anhydride copolymers, hydrolyzed ethylene-maleic anhydride copolymers, hydrolyzed isobutylene-maleic anhydride copolymers, polyvinyl alcohol, carboxy-modified polyvinyl alcohol, and polyacrylamide.

The water-insoluble binder for the subbing layer generally includes synthetic rubber latexes and synthetic resin emulsions. Specific examples thereof include styrenebutadiene rubber latexes, acrylonitrile-butadiene rubber latexes, methyl acrylate-butadiene rubber latexes, vinyl acetate emulsions, and the like.

The binder generally is used in an amount ranging from 3 to 100 % by weight, preferably 5 to 50 % by weight based on the pigment. The subbing layer may contain a wax, an anti-fading agent, a surface active agent, and other additives.

Examples of pigment employed as additives for the color-developing layer or the protective layer include kaolin, calcined kaolin, talc, agalmatolite, diatomaceous earth, calcium carbonate, aluminum hydroxide, magnesium hydroxide, zinc oxide, lithopone, amorphous silica, colloidal silica, calcined gypsum, silica, magnesium carbonate, titanium oxide, alumina, barium carbonate, mica, microballoons, urea-formaldehyde fillers, polyester particles, cellulose fillers, and the like.

Examples of suitable metal soaps for the color-developing layer or the protective layer include multivalent metal salts of a higher fatty acid such as zinc stearate, aluminum stearate, calcium stearate, and zinc oleate.

For the purpose of improving head-matching properties for facsimile use, a wax having a melting point in the range of from 40° to 120° C. is preferably used additionally for the color-developing layer or the protective layer.

Waxes having a melting point of 40° to 120° C are suitable and examples include paraffin wax, polyethylene wax, carnauba wax, microcrystalline wax, candelilla wax, montan wax, and fatty acid amide wax. Among them, paraffin wax, microcrystalline wax, montan wax, and fatty acid amide wax are preferred. Paraffin waxes having a melting point in the range of from 50° to 100° C., montan wax, and methylolstearamide are particularly preferred. The wax is used in an amount of from 5 to 200% by weight, preferably 20 to 150% by weight, based on the electron-donating colorless dye.

Preferred hindered phenols are phenol derivatives having at least one branched alkyl substituent in at least one of the 2- and 6-positions.

Examples of water-resistance-improving agent which can be used include water-soluble initial-stage condensates such as N-methylolurea, N-methylolmelamine, and ureaformaldehyde; dialdehyde compounds such as glyoxal, and glutaraldehyde; inorganic crosslinking agents such as boric acid and borax; polyacrylic acid, methylvinyl ether-maleic acid copolymer, and isobutylene-maleic anhydride copolymer.

The protective layer is produced using a water-soluble polymer or a water-insoluble polymer. Examples of suitable water-soluble polymers include polyvinyl alcohol, carboxy-modified polyvinyl alcohol, vinyl acetate-acrylamide copolymers, silicon-modified polyvinyl alcohol, starch, modified starch, methylcellulose, carboxymethylcellulose, hydroxymethylcellulose, gelatin and its derivatives, gum arabic, casein, hydrolyzed styrene-maleic acid copolymers, hydrolyzed styrene-maleic acid copolymer half esters, hydrolyzed isobutylene-maleic anhydride copolymers, polyacrylamide derivatives, polyvinylpyrrolidone, sodium polystyrenesulfonate, and sodium alginate. Examples of suitable water-insoluble polymers include styrene-butadiene rubber latexes, acrylonitrile-butadiene rubber latexes, methyl acrylate-butadiene rubber latexes, and vinyl acetate emulsions.

The protective layer may contain a pigment, metal soap, wax, water-resistance-improving agent, and the like for improving matching properties with a thermal head.

The protective layer may further contain a surface active agent for the purpose of forming a uniform protective layer by application of a coating liquid on the heat-sensitive color-developing layer. Preferred surface active agents include alkali metal sulfosuccinates, fluorine-containing surface active agents, and the like. Any anionic surface active agent is effective. Specifically, preferred are sodium or ammonium di-(n-hexyl)sulfosuccinic acid, di(2-ethylhexyl)sulfosuccinic acid, and the like.

The electron-donating colorless dye may be enclosed in microcapsules in the heat-sensitive recording material of the present invention. The wall of the microcapsule has the characteristic that the wall, which is impermeable, allows, on heating, the colorless dye and/or the color-developing agent to pass through it. The microcapsules employed are particularly preferably made from materials such as polyurea, polyurethane, a polyurethane-polyurea mixture, a ureaformaldehyde resin, a mixture of polyurea with another synthetic resin, a mixture of polyurethane with another synthetic resin, polyester, polyamide, and the like.

The microcapsules are made by emulsifying for example, an oil drop as a core substance, and forming a polymer wall enclosing the oil drop of the core substance. The reactant for forming the polymer is added to the interior and/or the exterior of the oil drop. Specific examples of suitable polymer substance are polyurethanes, polyureas, polyamides, polyesters, polycarbonates, urea-formaldehyde resins, melamine resins, polystyrenes, styrene-methacrylate copolymers, styrene-acrylate copolymers, and the like. Specific examples of microcapsule production techniques and compounds used therein are described, for example, in U.S. Pat. Nos. 3,726,804 and 3,796,669.

In forming the microcapsules, a water-soluble polymer may be employed as a protective colloid. Examples of water-soluble polymers include water-soluble anionic polymers, water-soluble nonionic polymers, and water-soluble amphoteric polymers. The anionic polymers may be natural or synthetic. Specific examples are those containing —COOH groups, —$SO_3$ groups, or the like.

Specifically, examples of natural anionic polymers include gum arabic, alginic acid, etc., and semi-synthetic ones include carboxymethylcellulose, phthalated gelatin, sulfated starch, sulfated cellulose, lignin sulfonic acid, etc.

Examples of synthetic polymers include maleic anhydride type copolymers (including hydrolyzed products thereof), acrylic type (and methacrylic type) polymers and copolymers, vinylbenzenesulfonic type polymers, carboxy-modified polyvinyl alcohol, etc.

Examples of suitable nonionic polymers include polyvinyl alcohol, hydroxyethylcellulose, methylcellulose, etc.

Typical amphoteric polymers include gelatin and the like.

The water-soluble polymer is used in a form of an aqueous solution having a concentration of 0.01 to 10 % by weight.

The organic solvent employed in formation of the microcapsule preferably has a boiling point of 180° C. or higher since low boiling solvents tend to evaporate off during storage before use. As the organic solvent, those having no vinyl polymerizability are preferred and typical examples thereof include phosphoric esters, phthalic esters, other carboxylic esters, fatty acid amides, alkylated biphenyls, alkylated terphenyls, chlorinated paraffin, alkylated naphthalene, diarylethans, and so forth. Specific examples are tricresyl phosphate, trioctyl phosphate, octyl diphenyl phosphate, tricyclohexyl phosphate, dibutyl phthalate, dioctyl phthalate, dilauryl phthalate, dicyclohexyl phthalate, butyl oleate, diethylene glycol dibenzoate, dioctyl sebacate, dibutyl sebacate, dioctyl adipate, trioctyl trimellitate, triethyl acetylcitrate, dibutyl maleate, isopropylbiphenyl, chlorinated paraffin, diisopropylnaphthalene, 1,1'-ditolylethane, 2,4-di-t-amylphenol, N,N-dibutyl-2-butoxy-5-t-octylaniline, and so forth.

The microcapsules may contain an additive such as a known UV-absorbing agent or a known antioxidizing agent.

The heat-sensitive recording material of the present invention may be provided with a UV-absorbing layer in shape as described in JP-A-63-265682, etc. Specifically, a coating liquid dispersion is prepared which contains microcapsules enclosing an electron-donating colorless dye, and an emulsion dispersion of an electron-accepting compound as the main components, and a binder and other additives. Another coating liquid is prepared for the UV-absorbing layer. The heat-sensitive recording material is produced by applying and drying the coating liquids on a support such as a paper sheet and a synthetic resin film using bar coating, blade coating, air-knife coating, gravure coating, roll coating, spray coating, dip coating, or other coating methods.

The emulsion dispersion of the electron-accepting compound is readily prepared by mixing and dispersing an oil phase containing the electron-accepting compound and an aqueous phase containing a protective colloid and a surface active agent using conventional fine particle emulsification methods such as high-speed agitation and ultrasonic dispersion.

The emulsion dispersion may contain suitably a melting point-lowering agent for the electron-accepting compound. Some melting point-lowering agents have also the function of controlling the glass transition point of the above-described capsule wall. Examples of such compounds include hydroxy compounds, carbamate esters, sulfonamides, and aromatic methoxy compounds, which are described in detail in JP-A-61-121990 and other literature.

The melting point-lowering agent may be used suitably in an amount from 0.1 to 2 parts by weight, preferably from 0.5 to 1 part by weight, based on one part of the electron-accepting compound for which a lower melting point is desired, and is preferably added at the same layer as that of the electron-accepting compound. If added separately, the melting point-lowering agent is preferably added in an amount one to three times the amount described above.

For the purpose of preventing adhesion to the thermal head or of improving writing-quality, a pigment such as silica, barium sulfate, titanium oxide, aluminum hydroxide, zinc oxide, and calcium carbonate, or a fine powdery material such as styrene beads and fine urea-melamine resin particles may be added. In order to retain the transparency of the heat-sensitive layer, the protective layer is provided on the heat-sensitive layer in conventional manner for storability and stability of the heat-sensitive layer, and the pigment or the fine powdery material is preferably added to the protective layer. Protective layers are described in detail in the literature, for example, in "Kami-parupu Gijutsu Taimusu (Paper and Pulp Technology Times)" pp. 2–4, Sep., 1985.

Similarly, a metal soap may be added to prevent adhesion.

Suitable binders include polyvinyl alcohol, methylcellulose, carboxymethylcellulose, hydroxypropylcellulose, gum arabic, gelatin, polyvinylpyrrolidone, casein, styrenebutadiene latex emulsions, acrylonitrile-butadiene latex emulsions, polyvinyl acetate, polyacrylic ester, ethylenevinyl acetate copolymer and the like.

Examples of the present invention are set forth below without limiting the invention. The quantities in the Examples are by weight unless otherwise indicated.

EXAMPLE 1

Onto a transparent polyethylene terephthalate film, a UV-absorbing layer, a heat-sensitive color-developing layer, and a protective layer having the compositions shown below were applied simultaneously in multi-layers and dried to prepare a test sample.

First layer: UV-absorbing Layer

As UV-absorbing agents, 10 parts of 2-(3,5-di-t-butyl-2-hydroxyphenyl)-5-chlorobenzotriazole, 26 parts of 2(5-t-butyl-2-hydroxyphenyl)benzotriazole, and 47 parts of 2-(3-t-butyl-5-s-butyl-2-hydroxyphenyl)benzotriazole were dissolved by heating in a mixture of 42 parts of trinonyl phosphate as a high-boiling solvent with 47 parts of ethyl acetate. The resulting solution was added to a gelatin solution containing sodium triisopropylnaphthalenesulfonate, and the mixture was emulsified using a colloid mill to produce a volume average particle size of 0.4 μm. 200 Parts of 8% gelatin solution was added to this liquid emulsion to prepare a coating liquid.

When this coating liquid was applied alone on a transparent polyethylene terephthalate film in a coating amount of 2.0 g/m$^2$, the coated sample exhibited a transmittance of 45% at 400 nm, 0.8% at 375 nm, and an entire overall visible light transmittance of 92%.

Second Layer: Heat-Sensitive Color-Developing Layer 20 g of each of 2-anilino-3-methyl-6-N-ethyl-N-isoamylaminofluoran, bisphenol A, and benzyl 2-naphthyl ether were respectively dispersed in 100 g of an aqueous 5% gelatin solution using a ball mill for 24 hours to give a volume average particle size of 3 μm. Separately, 80 g of calcined kaolin (Anisilex-93, produced by ENGELHARD Co.) was dispersed in 160 g of a 0.5% sodium hexametaphosphate solution using a homogenizer.

The liquid dispersions obtained were mixed in proportions of 5 g of the electron-donating colorless dye dispersion, 10 g of the electron-accepting compound liquid dispersion, 10 g of the heat-fusible substance liquid dispersion, and 22 g of the calcined kaolin liquid dispersion. Further thereto, 4 g of a 20% zinc stearate emulsion and 5 g of an aqueous 2% sodium (2-ethylhexyl)sulfosuccinate solution were added to obtain a coating liquid.

Third layer: Protective Layer

1 Part of a 2% sodium di-(ethylhexyl)sulfosuccinate solution, 1.8 parts of a 20% zinc stearate emulsion, and 13 parts of a 50% kaolin liquid dispersion were added to 14 parts of a 8% gelatin solution to prepare a coating liquid for the protective layer.

The coating liquids were applied on a transparent polyethylene terephthalate film by simultaneous multi-layer coating in coating amounts of 2.0 g/m$^2$ for the first layer, 6 g/m$^2$ for the second layer, and 2 g/m$^2$ for the third layer, thus preparing a test sample.

EXAMPLE 2

A test sample was prepared in the same manner as in Example 1 except that the second layer, namely the heat-sensitive color-developing layer, was changed to a layer as described below.

Second Layer: Heat-Sensitive Color-Developing Layer

2 Parts of 2-methyl-3-anilino-7-cyclohexyl-N-methylaminofluoran as the color-developing agent, and 18 parts of a 3:1-adduct of xylylene diisocyanate with trimethylolpropane were dissolved by heating in a mixed solvent of 24 parts of diisopropylnaphthalene and 5 parts of ethyl acetate. The resulting leuco dye solution was mixed with an aqueous solution of 3.5 parts of polyvinyl alcohol, 1.7 parts of gelatin, and 2.4 parts of 1,4-di(hydroxyethoxy)benzene in 58 parts of water, and dispersed to produce an emulsion having a volume average particle size of 1 μm. To the resulting liquid emulsion, 100 parts of water was added, and the mixture was heated to 60° C. with stirring. Thus 2 hours later, a capsule liquid containing the leuco dye in the core was produced.

Separately, 20 parts of bisphenol A was dispersed in 100 parts of an aqueous 5% polyvinyl alcohol solution for 3 hours to obtain a bisphenol A liquid dispersion having a volume average particle diameter of 1 μm.

40 Parts of calcium carbonate (Uniber-7, made by Shiraishi Kogyo K.K.) was dispersed in 60 parts of water using a sand mill to obtain a liquid dispersion having a volume average particle size of 1.5 μm.

40 Parts of the capsule liquid, 20 parts of the bisphenol A liquid dispersion, 15 parts of the pigment liquid dispersion obtained above, and 3 parts of a 2% sodium di(2-ethylhexyl)sulfosuccinate solution as a surface active agent were mixed to prepare the coating liquid.

The resulting coating liquids were applied on a transparent polyethylene terephthalate film by simultaneous multi-layer coating in coating amounts of 2.0 g/m$^2$ for the first layer, 10 g/m$^2$ for the second layer, and 2 g/m$^2$ for the third layer.

EXAMPLE 3

A sample was prepared in the same manner as in Example 1 except that the second layer, namely the heat-sensitive color-developing layer, was changed to a layer as described below.

Second Layer: Heat-Sensitive Color-Developing Layer

The capsule was prepared by using the diazo compounds below.

Diazo Compound A

-continued

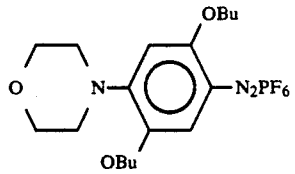

Diazo Compound B

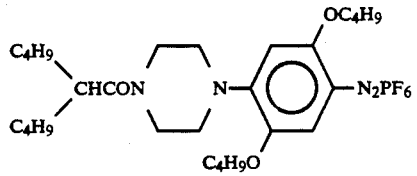

1 Part of Diazo Compound A, 1 part of Diazo Compound B, 6 parts of a 3:1-adduct of tolylene diisocyanate with trimethylolpropane, and 18 parts of a 3:1-adduct of xylylene diisocyanate with trimethylolpropane were dissolved by heating in a mixed solvent of 24 parts of dibutyl phthalate with 5 parts of ethyl acetate. This diazo compound solution was mixed with an aqueous solution of 3.5 parts of polyvinyl alcohol and 1.7 parts of gelatin in 58 parts of water and the mixture was dispersed to obtain an emulsion having a volume average particle size of 1 μm. To the resulting liquid emulsion, 100 parts of water was added, and the emulsion was heated to 50° C. with stirring. After 2 hours, a capsule liquid containing the diazo compound in the core was obtained.

Separately, 16 parts of 2-hydroxy-3-naphthoic acid anilide and 4 parts of the compound shown below were dispersed in 100 parts of an aqueous 5% polyvinyl alcohol solution for 3 hours using a sand mill to obtain a dispersion of a coupling component having a volume average particle size of 1 μm.

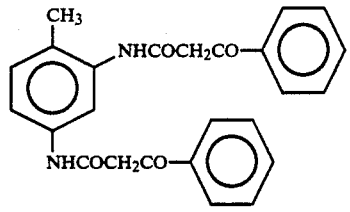

20 Parts of triphenylguanidine was dispersed in 100 parts of an aqueous 5% polyvinyl alcohol solution for 3 hours using a sand mill to obtain a liquid dispersion having a volume-average particle size of 1 μm.

Further, 20 parts of p-benzyloxyphenol was dispersed in 100 parts of an aqueous 5% polyvinyl alcohol solution for 3 hours using a sand mill to obtain a liquid dispersion of p-benzyloxyphenol having a volume average particle size of 1 μm.

The coating liquid was prepared by mixing 50 parts of the capsule liquid, 15 parts of the coupling component dispersion, and 15 parts of triphenylguanidine dispersion, prepared respectively as described above, and 15 parts of a calcium carbonate liquid dispersion prepared as described in Example 6.

The resulting coating liquids were applied on a transparent polyethylene terephthalate film by simultaneous multi-layer coating in coating amounts of 2.0 g/m$^2$ for the first layer, 10 g/m$^2$ for the second layer, and 2 g/m$^2$ for the third layer to prepare a test sample.

EXAMPLE 4

Onto a transparent polyethylene terephthalate film, a first UV-absorbing layer, a heat-sensitive color-developing layer, a second UV-absorbing layer, and a protective layer as described below were successively applied simultaneously in multi-layers and dried to prepare a test recording sample.

First layer: UV-absorbing Layer

As UV-absorbing agents, 39 parts of 2-(2'-hydroxy-5'-t-octylphenyl)benzotriazole, 20 parts of 2-(3-t-butyl-5-methyl-2-hydroxyphenyl)-5-chlorobenzotriazole, 8 parts of 2-hydroxyphenyl salicylate, and 11 parts of 2-hydroxy-4-methoxybenzophenone were dissolved by heating in a mixed solvent of 77 parts diisopropylnaphthalene and 15 parts of ethyl acetate. The resulting solution was added to a gelatin solution containing sodium triisopropylnaphthalenesulfonate, and the mixture was emulsified using a colloidal mill to prepare an emulsion having a volume-average particle size of 0.4 μm. To this emulsion 200 parts of an 8% gelatin solution was further added to prepare a coating liquid.

When this coating liquid was applied alone on a transparent polyethylene terephthalate film in a coating amount of 2.0 g/m$^2$, the coated sample exhibited a transmittance of 65% at 400 nm, 3% at 375 nm, and an entire visible light transmittance of 91%.

Second Layer: Heat-Sensitive Color-Developing Layer

12 Parts of 2-anilino-3-methyl-6-N-ethyl-N-isoamylaminofluoran and 20 parts of a 3:1-adduct of tolylene diisocyanate with trimethylolpropane were dissolved by heating in a mixed solvent of 12 parts of 1-phenyl-1-xylylethane and 20 parts of methylene chloride. The resulting leuco dye solution was mixed with 60 parts of an aqueous 8% polyvinyl alcohol solution and 20 parts of water. The mixture was dispersed and emulsified using a homogenizer to prepare an emulsion with oil drops of average volume average particle size of 1.0 μm. To this liquid emulsion, 120 parts of water was further added, and reacted at 40° C. for 3 hours to produce a capsule liquid.

Separately, 5 parts, 2 parts, and 8 parts respectively of the color-developing agents represented by the structural formulas C (provided that this compound is used in the form of a zinc salt), D, and E below were dissolved by heating in a mixture of 1 part of 1-phenyl-1-xylylethane and 7 parts of ethyl acetate. The resulting color-developing agent solution was mixed with 37 parts of an aqueous 8% polyvinyl alcohol solution and an aqueous solution of 0.2 part of sodium dodecylbenzenesulfonate in 35 parts of water, and the mixture was treated by a homogenizer to produce a liquid emulsion having a volume average particle size of 1.5 μm.

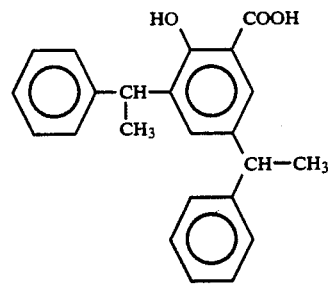

(C)

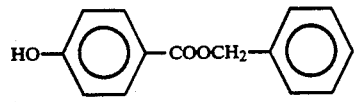

(D)

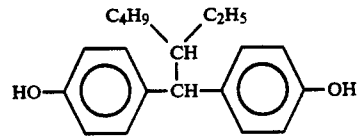

(E)

5.0 Parts of the capsule liquid and 10.0 parts of the color-developing agent liquid emulsion prepared as described above, and 5.0 parts of water were stirred and mixed to obtain a coating liquid.

Third Layer: UV-absorbing layer

The same coating liquid as the liquid for the First Layer above was used as the UV-absorbing layer.

Fourth Layer: Protecting Layer 2 parts of an aqueous 8% polyvinyl alcohol solution, an aqueous 40% kaolin dispersion, 0.1 part of an aqueous 4% boric acid solution, 0.2 part of a 20% zinc stearate dispersion, and 0.05 parts of ammonium laurate were dispersed using a homogenizer to prepare a coating liquid for the protective layer.

The resulting coating liquids were applied on a transparent polyethylene terephthalate film by simultaneous multi-layer coating in coating amounts of 2.0 g/m$^2$ for the first layer, 6 g/m$^2$ for the second layer, 2 g/m$^2$ for the third layer and 2 g/m$^2$ for the fourth layer to prepare a test sample.

COMPARATIVE EXAMPLES 1 TO 4

Test samples of Comparative Examples 1 to 4 were prepared by applying coating solutions for a heat-sensitive color-developing layer and a protective layer respectively by simultaneous multi-layer coating on a transparent polyethylene terephthalate film in the same manner as in Examples 1 to 4 except that the UV-absorbing layer or layers were not provided.

Picture images were printed on the test samples obtained in the above Examples and Comparative Examples using a thermal printer (Thermal Imager FTI-210, made by Fuji Photo Film Co., Ltd.). The light-fastness was tested by illuminating the test samples with a fluorescent lamp (32,000 lux) at 25° C. for 3 days. The differences in the optical densities before and after the light illumination were measured using a densitometer (RD-918 made by MacBeth Co.); and yellowness values were measured for the non-image portions and visual density were determined for the imaged portion.

The results obtained are shown in Table 1 and Table 2 below.

TABLE 1

| Coloring of Non-Image Portion by Light Illumination | | |
|---|---|---|
| | Density | |
| Sample | Before Illumination | After Illumination |
| Example 1 | 0.13 | 0.14 |
| Example 2 | 0.15 | 0.20 |
| Example 3 | 0.19 | 0.20 |
| Example 4 | 0.20 | 0.23 |
| Comparative Example 1 | 0.12 | 0.21 |
| Comparative Example 2 | 0.15 | 0.35 |
| Comparative Example 3 | 0.18 | 0.25 |
| Comparative Example 4 | 0.20 | 0.32 |

TABLE 2

| Fading of Image Portion by Light Illumination | | |
|---|---|---|
| | Density | |
| Sample | Before Illumination | After Illumination |
| Example 1 | 2.10 | 2.05 |
| Example 2 | 2.00 | 1.98 |
| Example 3 | 1.80 | 1.80 |
| Example 4 | 2.15 | 2.13 |
| Comparative Example 1 | 2.13 | 1.65 |
| Comparative Example 2 | 2.03 | 1.89 |
| Comparative Example 3 | 1.80 | 1.70 |
| Comparative Example 4 | 2.15 | 2.00 |

As shown by the results in Table 1 and Table 2, the increase of color of the non-image portions by light illumination and fading of the image portion by light illumination are greatly alleviated in the samples of this invention.

EXAMPLE 5

Coating liquids were prepared for a UV-absorbing layer, a color-developing layer and a protecting layer using the procedure described below.

Light-UV-absorbing Layer 3.9 Parts of UV-541, a benzotriazole type UV-absorbing agent (made by Cyanamid Co., U.S.A.), 2.0 parts of Tinuvin-326 (made by Ciba Geigy Co.), 0.8 part of UV-24, a benzophenone type UV-absorbing agent (made by Cyanamid Co., U.S.A.), and 1.1 parts of Sumisorb-110 (made by Sumitomo Chemical Co., Ltd.) were dissolved by heating in a mixed solvent of 7.7 parts of diisopropylnaphthalene with 15 parts of ethyl acetate. This UV-absorbing agent solution was mixed with an aqueous solution of 1.1 parts of polyvinyl alcohol in 40 parts of water. Thereto 4 parts of a surfactant solution containing 2% solid sodium di(2-ethylhexyl) sulfosuccinate was added, and dispersed to form an emulsion. Then the ethyl acetate was evaporated off by stirring at room temperature. The resulting liquid emulsion was used as the coating liquid for the UV-absorbing layer.

Color-Developing Layer 1.2 Parts of 2-p-trifluoromethylanilino-6-N-ethyl-N-isobutylaminofluoran and 10 parts of xylylene diisocyanate were dissolved in a mixed solution of 12 parts of isopropylnaphthalene, and 10 parts of ethyl acetate. This solution of the electron-donating colorless dye was mixed with an aqueous solution of 3 parts of polyvinyl alcohol in 46 parts of water, and emulsified at room temperature to prepare a liquid emulsion having an average particle size in the range of from 0.8 to 1.2 μm. To the resulting liquid emulsion, 30 parts of water was added, and the mixture was heated to 50° C. with stirring. After two hours, a capsule liquid was obtained which contained 2-p-trifluoromethyl-anilino-6-N-ethyl-N-isobutylaminofluoran in the core.

Separately, 40 parts of bisphenol A was added to 110 parts of an aqueous 5% polyvinyl alcohol solution, and dispersed using a sand mill to obtain a bisphenol A dispersion having an average particle size of 1.0 to 1.5 μm.

40 Parts of calcium carbonate, white pigment (Uniber-70, made by Shiraishi Kogyo K.K.), was added to 60 parts of water containing 0.4 parts of sodium metaphosphate as a dispersant, and dispersed using a sand mill to obtain a pigment dispersion having a particle size of about 1.5 μm.

30 Parts of the bisphenol A dispersion, 15 parts of the pigment dispersion, and 3 parts of 2% sodium di(2-ethylhexyl)-sulfosuccinate were added to 40 parts of the above capsule liquid, and dispersed. The resulting dispersion was used as the coating liquid for the color-developing layer.

Protective Layer

9 Parts of white pigment kaolin (KAOBRITE, made by Shiraishi Kogyo K.K.), and 9 parts of titanium oxide were added to 36 parts of water containing 0.18 part of sodium hexametaphosphate and dispersed to obtain a dispersion having an average particle size of 0.3 to 0.8 μm. Thereto, 40 parts of a polyvinyl alcohol solution of a solids content of 12 %, 4 parts of a solution of a releasing-type zinc stearate (Hydrin Z-7, made by Chukyo Yushi K.K.) of a solids content of 21%, 2.5 parts of a 4% boric acid solution, and 5 parts of sodium di-(2-ethylhexyl)-sulfosuccinate of a solids content of 2% were added and the mixture was stirred at room temperature. The resulting solution was used as the protective layer coating liquid.

Preparation of Heat-Sensitive Film

The coating liquids for the UV-absorbing layer, the color-developing layer and protective layer were successively applied and dried on a transparent polyethylene terephthalate film, respectively, in a coating amount of 0.8 g/m$^2$, 12.0 g/m$^2$, and 2.4 g/m$^2$, and the coated material was calendered to prepare a heat-sensitive film.

EXAMPLE 6

A heat-sensitive film was prepared in the same manner as in Example 5 except that 2-m-trifluoromethylanilino-6-N,N-diethylaminofluoran was used as the electron-donating colorless dye.

EXAMPLE 7

A heat-sensitive film was prepared in the same manner as in Example 5 except that 2-o-trifluoromethylanilino-6-N-ethyl-N-isopropylaminofluoran was used as the electrondonating colorless dye.

EXAMPLE 8

A heat-sensitive film was prepared in the same manner as in Example 5 except that 2-o-fluoroanilino-6-

N,N-dibutylaminofluoran was used as the electron-donating colorless dye.

REFERENTIAL EXAMPLE 1

A heat-sensitive film was prepared in the same manner as in Example 5 except that 2-anilino-3-methyl-6-N-ethyl-N-isobutylaminofluoran was used as the electron-donating colorless dye.

REFERENTIAL EXAMPLE 2

A heat-sensitive film was prepared in the same manner as in Example 5 except that 2-anilino-3-methyl-6-N,N-diethylaminofluoran was used as the electron-donating colorless dye.

REFERENTIAL EXAMPLE 3

A heat-sensitive film was prepared in the same manner as in Example 5 except that 2-anilino-3-methyl-6-N,N-dibutylaminofluoran was used as the electron-donating colorless dye.

The unprinted portion (namely the white ground) of the resulting heat-sensitive films were subjected to accelerated light-fastness test using a Weather-0-meter (made by Atlas Co, USA), wherein light is projected from a xenon lamp of an output of 6000 W as the light source for 24 hours from the side of the transparent support.

The optical density (yellowness value) of the white ground of the film after the light exposure was measured using a densitometer, RD-918 (made by MacBeth Co.). A lower yellowness value is desired.

The results obtained are shown in Table 3 below.

TABLE 3

| | Before Exposure | After Exposure with Weather-O-meter for 24 Hours |
|---|---|---|
| Example 5 | 0.146 | 0.209 |
| Example 6 | 0.152 | 0.227 |
| Example 7 | 0.146 | 0.157 |
| Example 8 | 0.149 | 0.230 |
| Referential Example 1 | 0.151 | 0.270 |
| Referential Example 2 | 0.146 | 0.300 |
| Referential Example 3 | 0.167 | 0.321 |

As shown in Table 3, the heat-sensitive films of the present invention are superior to those of the referential examples in terms of the light fastness of the white ground (unprinted portion).

While the invention has been described in detail and with reference to specific embodiments thereof, it will be apparent to one skilled in the art that various changes and modifications can be made therein without departing from the spirit and scope thereof.

What is claimed is:

1. A heat-sensitive recording material comprising a support having thereon a color-developing layer and at least one separate UV-absorbing layer with a light-transmittance of 70% or less at 400 nm, 5% or less at 370 nm, and 70% or more for entire visible light range.

2. The heat-sensitive recording material as claimed in claim 1, wherein the UV-absorbing layer has a transmittance of 50% or less at 400 nm, 1% or less at 370 nm, and 90% or more for entire visible light range.

3. The heat-sensitive recording material as claimed in claim 1, wherein said UV-absorbing layer contains two or more kinds of UV-absorbing agents.

4. The heat-sensitive recording material as claimed in claim 1, wherein said color-developing layer comprises a diazo compound, a coupling component, and an alkali-producing agent or a color-developing aid.

5. The heat-sensitive recording material as claimed in claim 1, wherein said color-developing layer comprises an electron-donating colorless dye and an electron-accepting compound.

6. The heat-sensitive recording material as claimed in claim 5, wherein said electron-donating colorless dye is a fluoran compound with an anilino group substituted at the benzene ring thereof with an electron-attracting group.

7. The heat-sensitive recording material as claimed in claim 6, wherein said fluoran compound is a compound represented by the following general formula (VII):

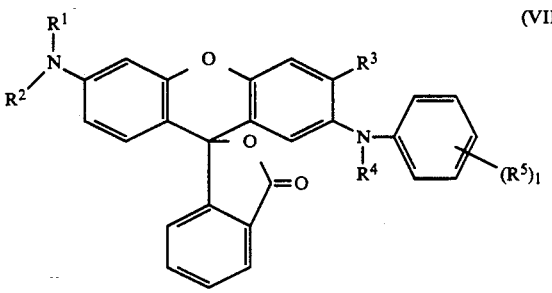

(VII)

wherein $R^1$ and $R^2$, which may be the same different, each represents a hydrogen atom, an unsubstituted or substituted alkyl, alkenyl, alkynyl, aralkyl, aryl, alkoxyalkyl, aryloxyalkyl or tetrahydrofurfuryl group, or $R^1$ and $R^2$ may combine together and form a hetero ring; $R^3$ represents a hydrogen atom, an alkyl group, an alkenyl group, an alkynyl group, an aralkyl group, an aryl group, an alkoxy group, an alkoxyalkyl group, an acyl group, a halogen atom, an alkylsulfonyl group or an arylsulfonyl group; $R^4$ represents a hydrogen atom, an unsubstituted or substituted alkyl, alkenyl, alkynyl, aralkyl, aryl, acyl, alkoxycarbonyl or aryloxycarbonyl group; $R^5$ represents an electron-attracting group; 1 is an integer of from 1 to 5, and when 1 is 2 or more, the $R^5$s may be the same or different.

* * * * *